United States Patent [19]

Nowlan

[11] Patent Number: 5,052,515

[45] Date of Patent: Oct. 1, 1991

[54] LADDER STEP SUPPORT

[76] Inventor: Bud C. Nowlan, 3958 Aldrich Ave. N., Minneapolis, Minn. 55412

[21] Appl. No.: 562,397

[22] Filed: Aug. 3, 1990

Related U.S. Application Data

[63] Continuation-in-part of Ser. No. 555,898, Jul. 20, 1990.

[51] Int. Cl.[5] ..... E06C 7/16

[52] U.S. Cl. ..... 182/121

[58] Field of Search ..... 182/121, 120, 122

[56] References Cited

U.S. PATENT DOCUMENTS

| | | |
|---|---|---|
| 745,750 | 12/1903 | Ziegler . |
| 1,216,214 | 2/1917 | Connell . |
| 1,487,243 | 3/1924 | Jackson . |
| 1,725,723 | 8/1929 | Silva . |
| 1,920,552 | 8/1933 | Dollerhide . |
| 2,282,133 | 5/1942 | Horton . |
| 2,297,883 | 10/1942 | Glover . |
| 2,439,185 | 4/1948 | Patt . |
| 2,500,559 | 3/1950 | Miller . |
| 2,553,322 | 5/1951 | Kurmer . |
| 2,876,047 | 3/1959 | Plante . |
| 3,067,836 | 12/1962 | Carnicelli . |
| 3,294,197 | 9/1964 | Kwiatkowski . |
| 3,511,338 | 5/1970 | Chapman . |
| 3,899,045 | 8/1975 | Geisel . |
| 4,085,819 | 4/1978 | Ohnstad . |
| 4,211,130 | 7/1980 | Ethridge . |
| 4,401,187 | 8/1983 | Van Patten . |
| 4,482,030 | 11/1984 | Lincourt . |
| 4,496,025 | 1/1985 | Gattman . |
| 4,646,878 | 3/1987 | Moyer . |
| 4,687,075 | 8/1987 | Skaggs . |
| 4,909,351 | 3/1990 | Johnson et al. . |

*Primary Examiner*—Reinaldo P. Machado

*Attorney, Agent, or Firm*—Grady J. Frenchick, Ltd.

[57] ABSTRACT

A substantially one-piece ladder attachment is disclosed. The attachment provides a secure, laterally well-supported platform on which a worker wound stand. The invention is particularly useful for an extension ladder, especially one with circular rungs. The attachment of the invention comprises a platform having a single, preferably hollow, vertical support member projecting adjacent one edge thereof. The vertical support is centrally disposed on the edge on which it is located. The vertical support angularly projects from the platform and is connected to an arcuate, horizontally disposed, transversely mounted upon bracket. The upper bracket is intended to engage the rung of a ladder to impart lateral stability to the platform. The attachment further includes a lower, horizontally-disposed, arcuate bracket which is located on the same edge of the platform as the vertical support. The lower bracket is intended to cooperate with a second rung of a ladder to provide lateral, as well as, vertical stability to said platform. In a preferred practice of this invention, grip means are adhered to the top of the platform. In a further preferred practice of the invention, a rung security means, such as key, is mounted in said upper bracket and through the support member to secure the attachment to the ladder.

7 Claims, 4 Drawing Sheets

LADDER STEP SUPPORT

CROSS-REFERENCE TO RELATED APPLICATION

This is a continuation-in-part of application Ser. No. 07/555,898 filed July 20, 1990.

BACKGROUND OF THE INVENTION

1. Field of Invention

The invention relates to a one piece, portable, or removable platform attachment or step support for a ladder. More particularly, the invention is directed to a one piece, detachable perch, platform, or ladder attachment which, in a preferred practice, can easily be locked into position. This invention is particularly for use by painters and other laborers who require stable footing when working while standing on a ladder. This invention is particularly suited to the situation where the work requires the laborer to stand on a platform for extended periods of time and at varying heights above ground level during the work activity.

The invention further relates to an improved ladder rung attachment or ladder step support. The device, in its preferred practice, fixes a platform in a generally horizontal plane, enabling the laborer to have stable footing thereon, without any obstruction from the ladder attachment. The device can also be used to place containers or articles thereon for the laborer's use over extended periods of work activity.

The invention can be used for a variety of applications, and the methods for constructing the device are more fully described herein.

2. Description of the Prior Art

Various prior art ladder attachment devices, and the like, as well as their apparatuses and the method of their construction in general, are known and are found to be exemplary of the U.S. prior art. They are:

| Inventor | U.S. Pat. No. |
|---|---|
| B. H. Ziegler and D. Betzner | 745,750 |
| C. M. Dollerhide | 1,920,552 |
| K. C. Miller | 2,500,559 |
| E. H. Chapman | 3,511,338 |
| W. R. Lincourt | 4,482,030 |
| R. J. Kwiatkowski | 3,294,197 |
| R. Moyer | 4,646,878 |
| C. E. Van Patten | 4,401,187 |
| F. W. Ethridge | 4,211,307 |
| W. J. Carnicelli | 3,067,836 |
| J. J. Glover | 2,297,883 |
| K. W. Horton | 2,282,133 |
| A. A. Silva | 1,725,723 |
| W. J. Connell | 1,216,214 |
| C. E. Johnson | 4,909,351 |
| J. W. Skaggs | 4,687,075 |

The Lincourt patent is for a safety platform which has L-shaped hooks used for attachment to the upper and lower rungs. Dollerhide shows a detachable ladder step secured to two rungs of the ladder; U-shaped hooks are used for securing the invention to the upper rung. Chapman's invention also utilizes U-shaped brackets, but uses them to secure the device to the lower rung; steel hooks secure the stand to the upper rung.

The Miller patent is directed to a ladder platform wherein the base is pivotally secured to one rung and swinging hook means are adjustable to various positions by means of notched formations in the side flanges of the platform.

The Ziegler and Betzner patent disclose an extension ladder with a moveable and adjustable shelf which is also secured in place by hooks projecting from the shelf to two rungs of the ladder. The extension feature of the ladder employs a bracing mechanism.

The Kwiatkowski patent discloses a perch for a ladder that sits upon one rung and has a cross member which engages the vertical support arms.

The Moyer patent discloses a portable ladder step having a portable attachment means having and a leveling means connected to the attachment means and the platform.

The Van Patten patent discloses a ladder platform accessory using resilient bracket arms in a hinged connection to the platform.

The Ethridge patent discloses a removable step for a ladder which permits the shelf or platform to be pivoted inward and outward so as not to obstruct normal use.

The United States Patent to Carnicelli is an adjustable step, for ladders utilizing two side members which contact the ladder rungs. The patents to Glover, Horton, Skaggs and Silva are variations on the type of construction of Carnicelli. The patent to Connell also is of analogous construction to that of Carnicelli.

The Johnson patent discloses a platform attachment for ladder having a retracted and a working position.

These patents or known prior uses teach and disclose various types of ladders and ladder attachment devices of sorts and of various manufacturers, and the like multiple piece ladder jacks and stabilizers, as well as methods of their construction. None of these references or other known devices, whether taken singly or in combination, disclose or suggest the specific details of the present invention, as claimed.

OBJECTS OF THE INVENTION

An object, advantage, and feature of the invention is to provide a novel, one-piece, portable or removable ladder attachment that is safe and efficient in use, providing its user with a stable platform fixed at a generally horizontal plane for placement of containers or like articles, or, more especially, for use as a platform to stand upon while working at heights above ground level.

In a preferred practice of the invention, it is directed further to a device providing for the easy locking of the attachment device into a desired position on the rungs of a ladder, and the easy removal thereof, without tools or complicated mechanical measures. In one practice of this invention, height adjustment can be accomplished while the user is standing on the ladder above ground level. This is a substantial improvement over existing devices whereby various types of hook assemblies or other means are utilized to suspend the ladder attachment on the ladder rungs.

Another object of the invention is to provide a novel and improved construction of securing a ladder attachment.

Another object of the invention is to provide a novel and improved method of construction of a ladder attachment whereby a locking mechanism is incorporated therein, allowing for the required stability essential for supporting a person at heights above ground level, and enabling said person to remove and reengage the attachment to different rungs of the ladder if needed to perform the desired work activity, e.g., at a different height above ground.

BRIEF SUMMARY OF THE INVENTION

These, together with other objects and advantages of the invention, reside in the Detailed Description of the Invention, as is more fully hereinafter described and claimed.

Briefly, in one aspect, the present invention is a one-piece ladder attachment or ladder step support. The attachment provides a secure, laterally well-supported platform on which a worker would stand. It permits easy adjustment of the vertical distance the platform is located above the ground. The invention is particularly useful for an extension ladder, especially one with circular rungs. The attachment of the invention comprises a platform having a single, vertical support member projecting from adjacent one edge thereof. The vertical support is centrally disposed on the edge on which it is located. If an especially rigid or heavy usage ladder attachment is desired, the vertical support member is preferably hollow. The vertical support angularly projects adjacent the edge of the platform and is connected to an arcuate, horizontally disposed, transversely mounted upper bracket. "Adjacent the edge" as used herein is intended to mean on the edge of the platform that is intersecting its edge or perimeter. It is also intended to mean disposed interiorly but near the edge or perimeter of the platform. The upper bracket is intended to engage the rung of a ladder to impart lateral stability to the platform. The attachment further includes a lower, horizontally-disposed, arcuate bracket which is securely mounted to the same edge of the platform as the vertical support. The lower bracket is not necessarily separate from or separately attached to the platform. The lower bracket may comprise downward projections from the bottom of the platform and the intervening platform underside. The lower bracket is intended to cooperate with a second rung of a ladder to provide lateral, as well as, vertical stability to said platform. In a preferred practice of this invention, grip means are adhered to the top of the platform. In a further preferred practice of the invention, a rung security means, such as a key or pin, is mounted in said upper bracket and through the support member to secure the attachment to the ladder. The optional security means in cooperation with the arcuate upper and lower brackets impart exceptional stability to the platform in the plane perpendicular, that is, away from, that of the ladder.

In utilization, the invention is carried to the work site, is attached to the rungs of a ladder with the platform at the desired height. The worker then climbs the ladder. The minimal projection of the platform from the plane of the ladder permits the ladder to be climbed with minimal interference by the attachment. The height above ground of the platform then can be easily and quickly changed to provide a comfortable, safe and convenient place for the worker to stand or to place equipment.

DETAILED DESCRIPTION OF THE INVENTION

Figure 1:
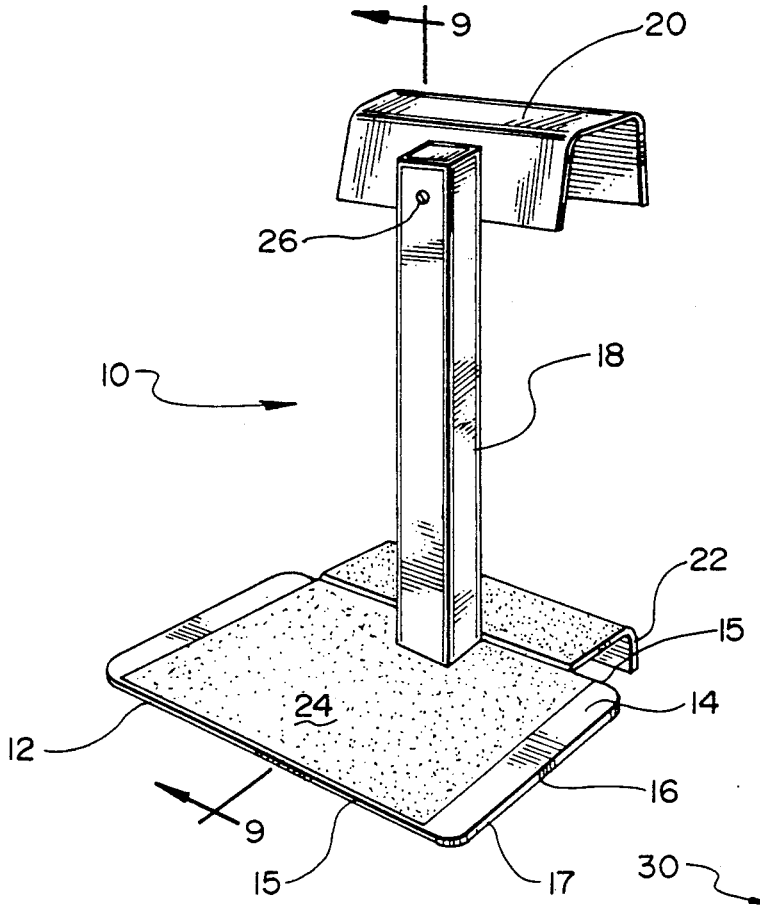
FIG. 1 is a perspective view of an apparatus or attachment of the present invention.
Figure 4:
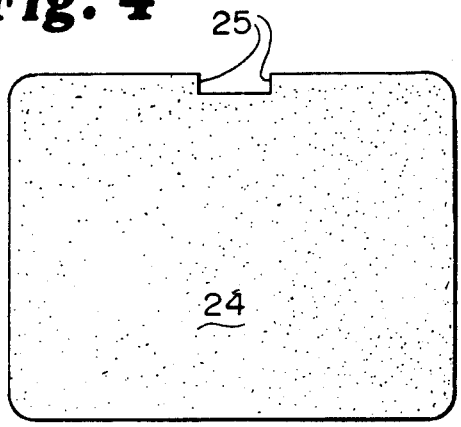
FIG. 4 is a plan view of the safety grip as shown in FIG. 1.

Reference is now made to the attached figures wherein like numerals are used to refer to like features of the invention in the various views. FIG. 1 is a perspective view of a ladder attachment 10 of the invention. Ladder attachment 10 comprises a rectangular platform 12 having a top 14 and a bottom 16. Rectangular platform 12 has substantially parallel long edges or dimensions 15 and short edges or dimensions 17. One of the long edges would be placed substantially adjacent to the plane of a ladder on which the instant attachment is to be employed. The same edge has a lip or notch 13 therein. Attachment 10 further includes a single, centrally disposed, angularly rigid L-shaped (in cross-section) vertical support member or spine 18 which is described in more detail below. Lastly, attachment 10 includes an upper rung bracket 20 and lower rung bracket 22 which also are described in more detail below. As shown in FIG. 1, plate 12 has an optional safety grip or tread 24. The general configuration of safety grip or tread 24, such as would be placed on the top 14 of platform 12, is shown in the plan view in FIG. 4. Tread 24 has a notch or cut-out 25 which permits support 18 to pass therethrough. Lastly, an optional securement means such as, for example, a safety pin 26 is shown passing through the upper portion of support member 18 and through upper bracket 20. This is most clearly shown in FIG. 9, below.

Figure 2:
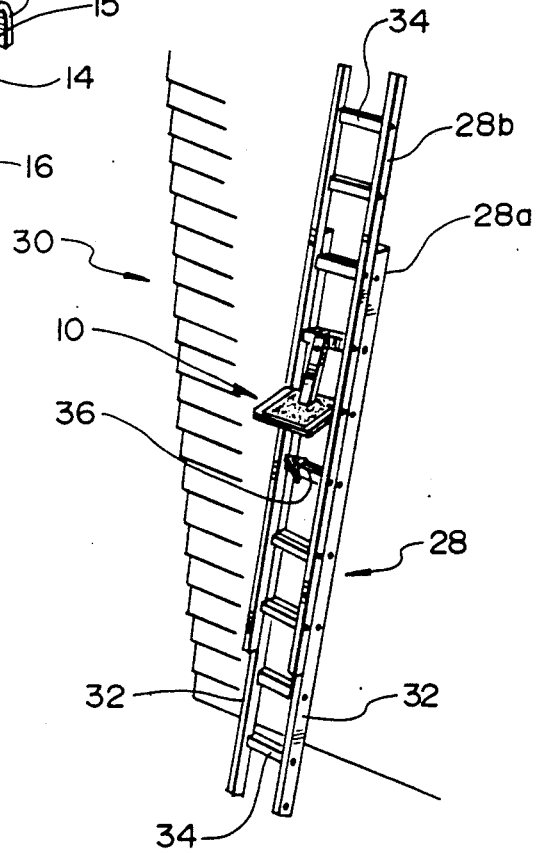
FIG. 2 is a perspective view of an apparatus of the present invention as it would be deployed on a ladder leaning against a building.

FIG. 2 shows an attachment of the present invention as it would appear if placed on a ladder 28 leaning against a building or house 30. Ladder 28 comprises two vertical supports or rails 32 and a plurality of horizontal supports, or rungs 34. Vertical supports 32 and rungs 34 generally define the plane of the ladder which, as shown, is angularly disposed with respect to building 30. The ladder shown in FIG. 2 is a particular variety of ladder, namely, an extension ladder. Ladder 28, therefore, comprises two segments 28*a*, 28*b* which are attached to each other by extension ladder lock 36. The present invention is preferably used with an extension ladder, but is more preferably used with any variety of ladder that has circular rungs.

In its preferred utilization, the plane of ladder 38 is approximately 70 degrees with respect to the vertical plane of the building 30. In this manner, optimum reach of the ladder is obtained whereas uniform distribution of the weight of a worker on the ladder is permitted. In a preferred practice of the invention, an aluminum extension ladder is employed in conjunction with this invention.

Figure 3:
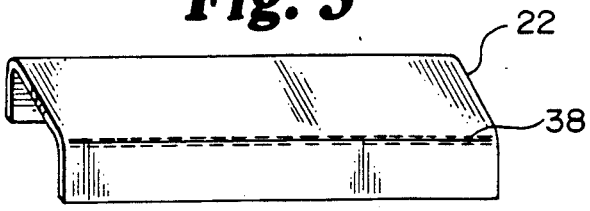
FIG. 3 is a lower bracket assembly for the invention as depicted in FIG. 1.
Figure 5:
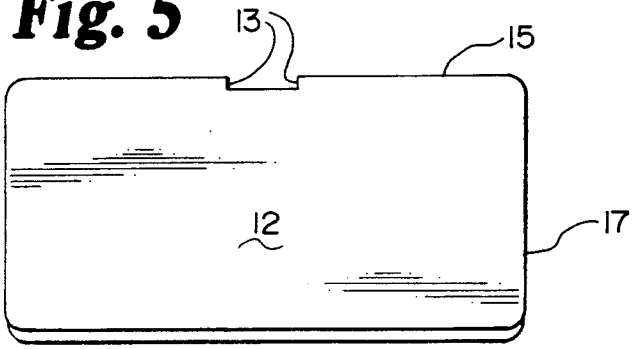
FIG. 5 is the step plate of the invention shown in FIG. 1.

FIG. 3 depicts a perspective view of lower rung bracket 22 which could be affixed to a long dimension 17 of platform 12. Lower bracket 22 is generally hemispherical or semi-circular in cross-section and may be referred to as "C-shaped". The precise cross-sectional shape of bracket 22 is not particularly important as long as it is sufficiently arcuate so as to cooperate with ladder rungs 34 so as to provide stability to platform 12. (A similar limitation applies to upper rung bracket 20 which is more clearly shown in FIG. 12.) The dotted bead or bend 38 of bracket 22 is generally the region in which it could be attached to the long edge of platform 12, which has lip 13 in it. Lower bracket 22 would be aggressively attached to platform 12 adjacent the edge having lip 13, such as for example, by welding. Lip 13 provides the opening through which a portion of vertical support member 18 projects. The extended portion of support member 18 which projects through lip 13 is then attached to the bottom 16 of platform 12.

Figure 6:
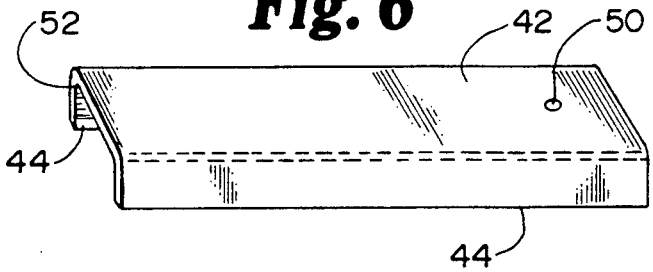
FIG. 6 is the spine stiffener of the invention shown in FIG. 1.
Figure 7:
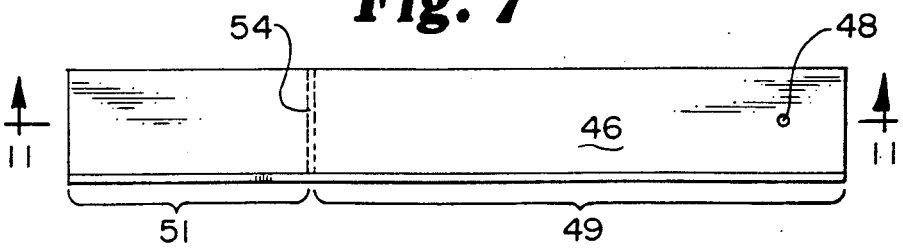
FIG. 7 is the L-shaped back member of the vertical support member shown in FIG. 1.

FIGS. 6 and 7 illustrate the two pieces which, in a preferred practice of this invention, are integrally secured to each other to create vertical support member 18. FIG. 6 depicts the arcuate, "U" or "C" shaped vertical support stiffener 42 whose long edges 44 would be, for example, welded to the oblique-angled, spine or support back member 46 shown (on its side) in FIG. 7. Back member 46 is shown in cross-section in FIG. 11. Back member 46 comprises a longer segment or leg 49 which bends (at 54) into a shorter segment or leg 51. Stiffener 42 would be approximately the same length as back member longer segment 49. The length of this portion of the invention would be determined by the vertical separation of ladder rungs. Generally, the stiffener 42 would be about twelve inches in length. Back member hole 48 would be lined up with vertical support stiffener hole 50 so as to permit a safety means, e.g., a screw and nut, (described below) to pass therethrough. In actual construction of the attachment, arcuate edge 52 would be welded to the top 14 of platform 12. FIG. 7 is a plan view of back member 46, the dotted bead or bend 54 indicating where the shorter leg 51 of back member 46 would angle into the plane of this paper.

Figure 8:
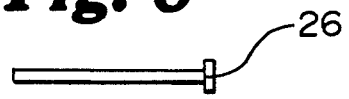
FIG. 8 is a side view of a safety pin which could be employed in the present invention to secure it to a ladder rung.

FIG. 8 depicts an optional safety pin 26 for the present attachment. Safety pin 56 could be a nut and screw arrangement. Alternatively, a spring-loaded mechanism could be attached to support member 18 so as to keep safety pin 26 permanently mounted thereon. In yet another embodiment, safety pin 26 could be connected to attachment 10, e.g., by means of a chain. Safety pin 26 could be held in attachment 10 by having a projection on one end thereof which would permit it to be withdrawn through back member hole 48 but not all the way out of the attachment. Various other rung securement means could be used.

Figure 9B:
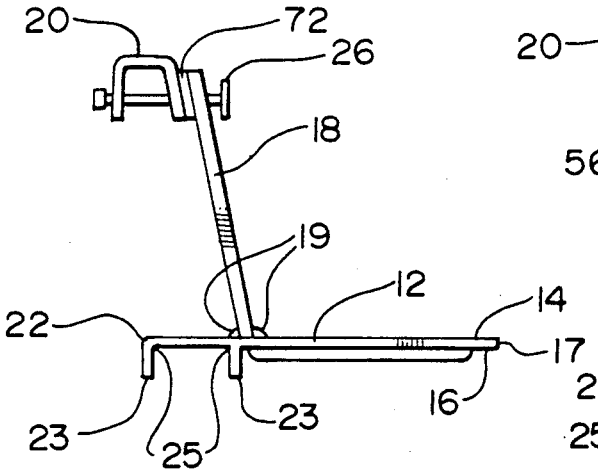
FIGS. 9*b* and 9*c* are sectional views of alternative embodiments of the invention if viewed along a line 9—9 in such alternative embodiments.
Figure 9A:
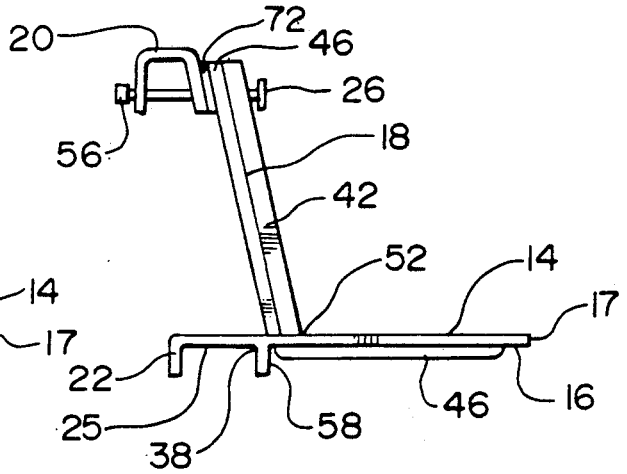
FIG. 9*a* is a sectional side view of the invention taken along line 9—9 in FIG. 1.

As shown in FIG. 9*a*, safety pin 26 passes through support stiffener 42 through back member 46 and continues on through upper bracket 22 and weld 72. Safety pin 26 passes through the above referenced holes in various components. A nut 56 can be attached to the end of safety pin 26 so as to prevent attachment 10 from detaching from ladder rung on which it is placed. Bead or bend 38 is the region of lower bracket 22 which is welded to the lip edge of platform 12 (at 58). Further, the arcuate edge 52 of vertical support stiffener 42 would be secured (e.g., welded) to the top 14 of rectangular platform 12. In this manner, vertical support member 18 provides angularly stable, lateral and transverse support to rectangular platform 12 when the device is placed upon ladder rungs. When the optional safety pin is used in conjunction with safety pin nut 56 to place attachment 10 on two rungs 34 of a ladder 28, a very stable and secure, substantially horizontal standing area (e.g., on optional tread 24) is provided.

Figure 9C:
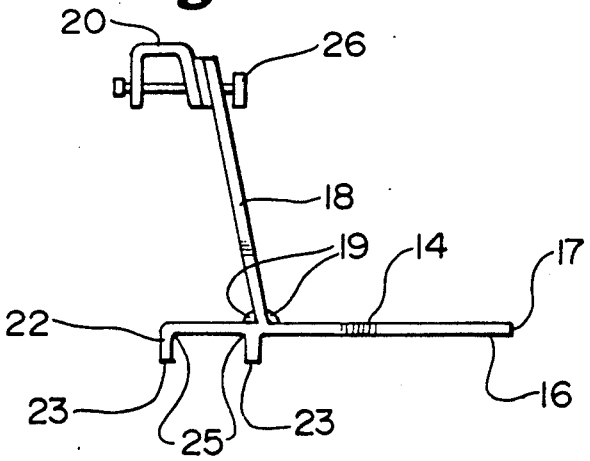

FIGS. 9*b* and 9*c* depict two additional constructions of the attachment in which a solid, preferably flat, but generally thicker, vertical support member 18 is utilized. Where a hollow, vertical support is utilized, the aluminum sheet may have a thickness in the range of $\frac{1}{4}$ inch. Where a solid vertical support is selected, thicker metal, e.g. $\frac{1}{2}$ in., must be employed. A thicker vertical support is needed to maintain the angularity of the support relative to the platform while the attachment is in use. FIG. 9*b* shows an embodiment of the invention where vertical support stiffener 42 has been deleted. This would be the equivalent of simply aggressively attaching back member 46 to platform 12 e.g., by using ribs to distribute the weight. FIG. 9*c* provides the same modification with the additional change that the short leg 51 of back member 46 has been deleted. In both of these embodiments vertical support member 18 must be very securely affixed adjacent the edge of platform 12, e.g., at weld 19.

FIGS. 9*a*, 9*b*, and 9*c* show an embodiment where lower bracket 22 comprises downward projections 23 from the bottom 16 of platform 12 and the bottom portion 25 of platform 12, therebetween. In other words, lower bracket 22 can be an integral part of platform 12, it not necessarily comprising a separate piece as shown in FIG. 3. Also as shown in FIGS. 9*a*, 9*b* and 9*c*, (as well as in FIG. 1) vertical support member 18 projects angularly upward from adjacent the edge (as opposed to on the edge) of platform 12. In a preferred embodiment, vertical support member 18 is inset from the edge of platform 12 by about the width of lower bracket 22.

Figure 10:
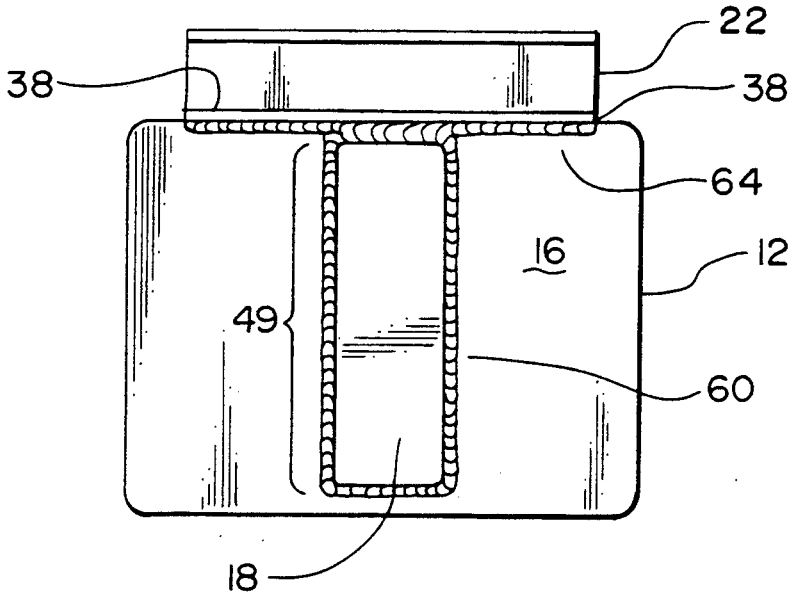
FIG. 10 is a bottom plan view of the invention shown in FIG. 1.

FIG. 10 shows a bottom plan view of attachment 10. The bottom 16 of platform 12 is shown to be welded by (bead 60) to the top 62 of support member 18. Lower bracket 22 is also shown to be welded to the lip edge of rectangular platform 12 by edge bead 64. Surprising and unexpected dimensional stability for the attachment is provided by this arrangement. In another practice, for support, ribs may be placed on platform bottom 16. Such ribs would generally be perpendicular to short leg 49.

Figure 11:
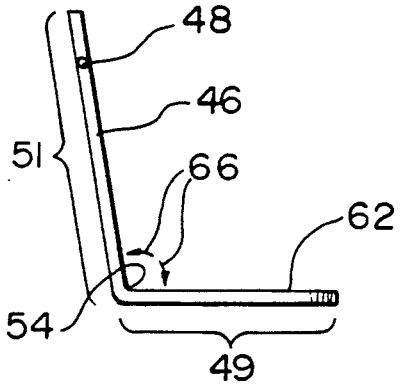
FIG. 11 is a section side view of a component of the attachment taken along line 11 of FIG. 6.

FIG. 11 shows, in section, back member 46 of FIG. 6. Arrows 66 generally indicate the angle that L-shaped vertical back member 18 maintains. For example, the angle between the back member long portion or leg 49, and the short portion or leg 51, of backing member 46 depicted in FIG. 11 would fall in the range of 10 to 20 degrees from a right angle. One skilled in this art will recognize that assuming platform 12 is to be substantially horizontal the angle subtended by arrow 66 will be determined by the preferred angle between the vertical face of the building 30 against which ladder 28 is leaning.

Figure 12:
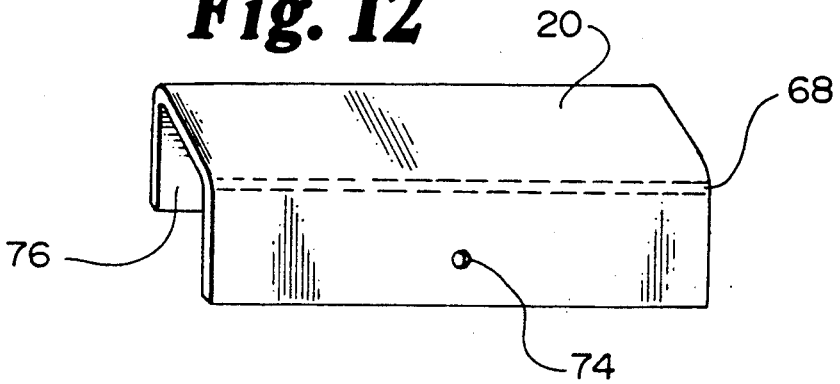
FIG. 12 is an upper bracket of the invention shown in FIG. 1.

FIG. 12 shows upper bracket 20 along with its bead or bend 68. Upper bracket bead or bend 68 will delineate upper bracket face 70 to which L-shaped support member 18 will be secured, e.g., by weld 72. Upper bracket hole 74 permits pin 26 to pass therethrough. Arrow 76 indicates the angle subtended by the ladder-side of upper bracket 20. In a preferred practice, the angle defined by arrow 76 is approximately 90 degrees. Other angles may be employed, if desired provided upper bracket 20 is substantially arcuate.

The dimensions of the attachment of the present invention are determined by the normal separation distance between the rungs of a ladder. Moreover, rectangular platform 12 would, of necessity, be narrower than the vertical separation of supports or rails 32. A typical size for platform 12 would be six inches by twelve inches. A preferred material from which the present attachment is made is aluminum. Generally, aluminum stock having a thickness of one-eight inch (for, e.g., the brackets) to three-sixteenths inch (for the stiffeners) is employed. Surprisingly an attachment of this invention has been found capable of supporting a worker on a ladder where the worker weight is three hundred to five hundred pounds.

In a typical practice of this invention, the worker places the ladder 28 against building 30. He/she then decides the height at which the worker wishes to have his/her feet. The one-piece, light-weight aspect of this invention permits the worker to carry the attachment to the ladder, attach it to the ladder at the requisite height, and then climb the ladder until the workers feet are thereon. The worker may then work comfortably for many hours while standing on platform 12. The dimension of the article and the single, central, vertical support, then permit the worker to demount from the ladder without substantial interference from the platform.

Many variations and alterations of the above invention will become readily obvious to one of ordinary skill in the art in view of the above disclosure. These alterations and variations are intended to be within the scope of the attached claims.

What is claimed is as follows:

1. A portable, removable, substantially one piece ladder attachment comprising:

a platform having a top and a bottom, a long and a short dimension, the platform having attached, adjacent a long dimension thereof;

a vertical support, the support angularly projecting adjacent the long dimension of said platform and being aggressively secured to said platform so as to maintain said angle, the support being connected, on its distal end to an arcuate, horizontally disposed and transversely mounted upper bracket, the bracket being adapted so as to hang on and cooperate with a first rung of a ladder; the platform further comprising:

a lower, arcuate, horizontally disposed bracket, said lower bracket being located on said platform along the same dimension as the support and being adapted to be placed over a second rung of a ladder to provide lateral stability to said platform.

2. An attachment according to claim 1 which further comprises rung securement means in said upper bracket.

3. An attachment according to claim 2 wherein said securement means is a safety pin which projects through said support and said upper bracket to transversely engage a ladder rung.

4. An attachment according to claim 1 which further comprises a safety grip adhered to the top of said platform.

5. An attachment according to claim 1 wherein the vertical support is hollow.

6. An attachment according to claim 1 wherein the vertical support is secured to the top and the bottom of the platform.

7. An attachment according to claim 1 wherein the vertical support comprises a flat, "L"-shaped back member and a cooperating, arcuate, support stiffener, the support stiffener being affixed to the longer leg of the back member along its edges.

* * * * *